US010443250B2

(12) United States Patent
Campbell

(10) Patent No.: US 10,443,250 B2
(45) Date of Patent: Oct. 15, 2019

(54) METHOD FOR CONTINUOUSLY EXTRUDING AND DEPOSITING AN UNBROKEN LAYER OF MORTAR ON A WORK SURFACE OR SUBSTRATE

(71) Applicant: Douglas S. Campbell, Redding, CA (US)

(72) Inventor: Douglas S. Campbell, Redding, CA (US)

( * ) Notice: Subject to any disclaimer, the term of this patent is extended or adjusted under 35 U.S.C. 154(b) by 784 days.

(21) Appl. No.: 14/880,977

(22) Filed: Oct. 12, 2015

(65) Prior Publication Data

US 2017/0101792 A1 Apr. 13, 2017
US 2019/0024395 A9 Jan. 24, 2019

Related U.S. Application Data

(62) Division of application No. 13/475,754, filed on May 18, 2012, now Pat. No. 9,157,246.

(60) Provisional application No. 61/487,471, filed on May 18, 2011.

(51) Int. Cl.
*E04G 21/04* (2006.01)
*E04G 21/20* (2006.01)

(52) U.S. Cl.
CPC ..... *E04G 21/0436* (2013.01); *E04G 21/04* (2013.01); *E04G 21/0418* (2013.01); *E04G 21/20* (2013.01); *E04G 21/202* (2013.01); *E04G 21/204* (2013.01); *E04G 21/206* (2013.01); *E04G 2021/049* (2013.01)

(58) Field of Classification Search
CPC ..... E04G 21/04; E04G 21/0418; E04G 21/20; E04G 21/202; E04G 21/206; E04G 21/204
See application file for complete search history.

(56) References Cited

U.S. PATENT DOCUMENTS 2,596,074 A * 5/1952 Hawes ..... B05B 9/0403 239/127
2,820,672 A * 1/1958 Arce ..... E04F 21/12 239/325
3,248,093 A * 4/1966 Demaison ..... B01F 3/1271 239/135
3,950,914 A * 4/1976 Lowen ..... E04G 21/22 414/10
4,049,022 A * 9/1977 Farahar ..... B28B 21/32 138/176
4,634,347 A * 1/1987 Gauffin ..... E04F 21/08 417/45
5,018,955 A * 5/1991 Parrish ..... E01C 19/4893 249/2

(Continued)

*Primary Examiner* — Jeffrey M Wollschlager
(74) *Attorney, Agent, or Firm* — McKinney & Associates, LLC; J. Andrew McKinney, Jr.

(57) ABSTRACT

A method for continuously extruding and depositing an unbroken layer of a slurry or mortar onto a selected work surface uses a mortar gun assembly with a chamber for receiving mortar from a remote supply hopper and an extruder configured to selectively apply a bead or ribbon of mortar of selected thickness onto the work surface. The user selectively applies mortar by controlling a rotating port valve between the hopper and the mortar gun chamber, and the rotating port valve provides a "rest state" in which the mortar is not sent to the mortar gun, but is instead re-circulated by the pump back to the hopper so un-dispensed mortar is kept moving and cannot dry or set.

8 Claims, 14 Drawing Sheets

(56) References Cited

U.S. PATENT DOCUMENTS

| | | | | | |
|---|---|---|---|---|---|
| 5,314,100 | A * | 5/1994 | Deaver | B28C 5/1223 | 222/236 |
| 5,443,211 | A * | 8/1995 | Young | B05B 7/1436 | 239/146 |
| 5,681,125 | A * | 10/1997 | Amaya | E04G 21/202 | 401/146 |
| 5,795,060 | A * | 8/1998 | Stephens | B01F 3/12 | 366/10 |
| 5,878,921 | A * | 3/1999 | Chase | B05B 7/1436 | 222/333 |
| 6,167,912 | B1 * | 1/2001 | Stephens | F16L 55/175 | 138/140 |
| 6,415,826 | B1 * | 7/2002 | DellaVecchia | E04G 21/20 | 141/263 |
| 6,806,298 | B1 * | 10/2004 | Nachtman | B05B 7/32 | 106/122 |
| 2006/0093536 | A1 * | 5/2006 | Selby | B01F 3/1221 | 422/234 |
| 2012/0328792 | A1 * | 12/2012 | Campbell | E04G 21/202 | 427/434.2 |

* cited by examiner

METHOD FOR CONTINUOUSLY EXTRUDING AND DEPOSITING AN UNBROKEN LAYER OF MORTAR ON A WORK SURFACE OR SUBSTRATE

REFERENCE TO PRIOR APPLICATIONS

This application claims the benefit of prior copending U.S. Non-Provisional application Ser. No. 13/475,754, filed May 18, 2012, and prior U.S. Provisional Application No. 61/487,471, filed May 18, 2011, the entire disclosures of which are incorporated herein by reference.

BACKGROUND OF THE INVENTION

Field of the Invention

The present invention relates to methods for building masonry structures such as brick and block walls, which are usually assembled by skilled masons by applying mortar to the top and side surfaces of the bricks or blocks and stacking them in a stable configuration, and to apparatus for applying the mortar by extruding it onto a surface at a selected rate.

Discussion of the Prior Art

Construction with traditional bricks or blocks is expensive, not only because materials are costly commodities, but because the labor required to build masonry structures is also costly. Therefore, the time taken by the building process is of unrelenting concern to property owners, developers and contractors, with the result that no mason can work quickly enough to satisfy everybody. The manual application of mortar in the correct amounts and locations on the top and side surfaces of the bricks or blocks and stacking them in a stable configuration and properly aligned takes time, and rushing a skilled mason may adversely impact the quality of the mason's work.

There have been attempts to find a way of automating some of the operations performed by the mason, and such efforts to partially automate the procedure of applying mortar to the top surfaces of a wall of bricks or blocks are described in several patents, such as U.S. Pat. No. 2,341,691 to Ciceske, U.S. Pat. No. 2,591,377 to Sadler, U.S. Pat. No. 3,545,159 to Brewer, U.S. Pat. No. 3,826,410 to Meyer, U.S. Pat. No. 4,135,651 to Hession et al., and U.S. Pat. No. 4,352,445 to Cusumano et al. These references show mortar applying devices that are pushed or pulled across the top surface of a wall. In addition, U.S. Pat. No. 2,683,981 to Richey, U.S. Pat. No. 3,791,559 to Foye, and U.S. Pat. No. 3,887,114 to Villanovich show wheeled mortar applying devices that are propelled across the top of a wall under construction by an operator turning a hand crank that drives the wheels. Most of these patents show the automated deposition of two beads of mortar along the top outer edges of blocks in a wall.

Many mortar applying devices use internal elements which contact the mortar while it is being deposited. For example, U.S. Pat. No. 3,162,886 to Wise discloses a mortar applying device which includes an auger for driving the mortar toward exit ports, U.S. Pat. No. 2,683,981 to Richey discloses the use of impellers to stir the mortar, U.S. Pat. No. 3,791,559 shows the use of mortar working blades, and U.S. Pat. No. 4,352,445 to Cusumano et al. shows the use of paddles to even out the mortar in the beads which have been laid.

On the other hand, U.S. Pat. No. 4,135,651 to Hession et al. and U.S. Pat. No. 3,545,159 to Brewer show the use of gravitational forces in dispensing the mortar on the blocks in a wall, and U.S. Pat. No. 3,826,410 to Meyer and U.S. Pat. No. 4,043,487 to Price show the use of gravitational forces assisted by vibration.

In the cases where gravity is used as the mortar feed mechanism, care must be taken to assure that the mortar is dispensed at approximately the same rate irrespective of the amount of mortar present in the feed mechanism hopper. Some prior mortar applying devices which use gravity suffer from the fact that mortar will be dispensed faster at the beginning of a run, when the hopper is full and a greater downward force is exerted by the weight of the mortar in the hopper, than at the end of the run when the hopper is nearly empty and a lesser downward force is exerted by the remaining mortar in the hopper. Such a situation leads to an uneven thickness of mortar in the wall, and this is unacceptable for proper construction.

Another problem arises when mortar is pumped to a tool for applying or dispensing, and then flow is stopped; for such stoppage can cause the mortar to start to cure in the tool, causing anything which contacts the stagnant mortar to become jammed, occluded, smeared or plugged, and this presents serious clean up problems for the user. If mortar is allowed to harden on the moving element, as would happen if the mortar applying device was not thoroughly washed at the end of a day, the mason is forced to chisel the element free of dried or curing mortar before the device can be used again.

There is a need, therefore, for an efficient, cost-effective and easy-to-use system and method for selectively extruding and applying a layer of mortar upon a selected surface which is to receive a masonry structure such as a course of bricks or blocks. Such a surface may be a concrete slab such as a patio, a pad or other surface, or may be an existing course of blocks or bricks.

OBJECTS AND SUMMARY OF THE INVENTION

Accordingly, it is an object of the present invention to overcome the above mentioned difficulties by providing an efficient, cost-effective and easy-to-use system and method for selectively extruding and applying a layer of mortar upon a selected surface, such as an existing slab or pad, or on the surface of a course of bricks or blocks.

In accordance with the present invention, a mortar extrusion and deposition system has a mortar gun which can be selectively activated to continuously extrude, in one embodiment, a continuous ribbon of substantially brick-width, continuous, rectangular cross-section, mortar that is particularly useful on a course of bricks or, in a second embodiment, a continuous pair of spaced-apart, rectangular cross-section beads of mortar, which may be referred to as a double bead layer, that is particularly applicable to a course of blocks. The mortar gun of the present invention is supplied with mortar from a remotely located hopper by way of a flexible hose so that the mortar supply will not add a potentially damaging or distorting weight onto the top of the course of bricks as might be experienced by users of gravitational feed systems, such as the system illustrated in U.S. Pat. No. 4,043,487 to Price. Such an arrangement makes the mortar gun easier to handle so that a less experienced mason can extrude a continuously precise thickness of mortar. In addition, since the gun of the present invention does not incorporate a hopper at the mortar gun, the weight of the mortar supply is not placed on the lower course when the beads or ribbons produced by the gun are being placed on a lower course bricks or blocks. Therefore, the mortar supply will not disturb the lower courses, as by compressing or displacing previously-laid mortar layers, as can occur when a heavy hopper compresses the thickness of previously applied, but uncured, mortar.

Briefly, the mortar gun assembly of the present invention includes a mortar chamber, or receptacle, which is connected at an inlet end, as by a quick-coupler fitting, to a supply hose to receive fluid material such as a mortar slurry from a remote supply hopper, and is connected at an outlet end to an extruder configured to apply mortar of selected thickness to a substrate such as a slab, a row of bricks or blocks, or to other suitable substrates. Support wheels facilitate movement of the gun along the surface onto which the mortar is to be applied, and side guides may be provided to direct the device along a row of bricks or blocks. A screed bar, or rake, is provided at the extruder outlet end to control the thickness of the applied material. A handle is secured to the top of the chamber to allow a user to manipulate the mortar gun, the handle carrying a manually operated on/off switch for controlling a mortar pump that supplies mortar from the hopper under pressure. A trigger is mounted on the handle and is selectively actuable by the user to control a rotating port valve connected to the mortar supply hose. In accordance with the present invention, the valve has an active state in which mortar is pumped at a selectable rate from the supply hopper to the mortar gun to be extruded out onto a substrate, and a rest state in which the mortar is not sent to the mortar gun, but is instead re-circulated back to the hopper so that it does not begin to dry or set. This recirculation also serves to reduce frictional heat buildup in the gun assembly.

The rotating valve is a significant and enabling feature of the mortar gun assembly of the present invention, for in its rest state it allows the mortar to keep moving, and allows the mortar mixture, which is in the form of a slurry, to stay fresh and useable. Prior art efforts that have attempted to control the speed of the mortar at the gun or the material exit part of the device have proven to be unworkable, messy and ultimately unproductive for the mason or user who is forced periodically to stop work to clean congealing or drying mortar from the application tools of the prior art.

Thus, the present invention provides a new and unique mortar gun and mortar extrusion and deposition method which overcomes the problems of the prior art by supplying mortar from a remote hopper to an extruder under the control of the operator so as to extrude controllable beads or ribbons of mortar onto a selected substrate. Whereas hand troweled mortar has peaks and valleys, and the brick needs to be tapped down to make the course level, the mortar gun of the present invention delivers a continuous, flat, even ribbon, or in a second embodiment, spaced beads, of mortar, thereby air pockets in the mortar, and providing a flat bed for the next course of brick to rest upon. The hand-held mortar gun of the present invention can be held by one hand, freeing up the user's other hand for handling brick. The method and apparatus of the invention thus provides numerous advantages over the prior art, including enabling brick or block to be laid at a faster speed, while requiring less skill or experience in masonry on the part of the user to obtain satisfactory results.

BRIEF DESCRIPTION OF THE FIGURES

The foregoing, and additional objects, features and advantages of the present invention will be more fully understood from the following detailed description of preferred embodiments of the invention, taken with the accompanying drawings, wherein like reference numerals in the various figures are utilized to designate like components, and in which.

DESCRIPTION OF THE PREFERRED EMBODIMENT

Figure 1:
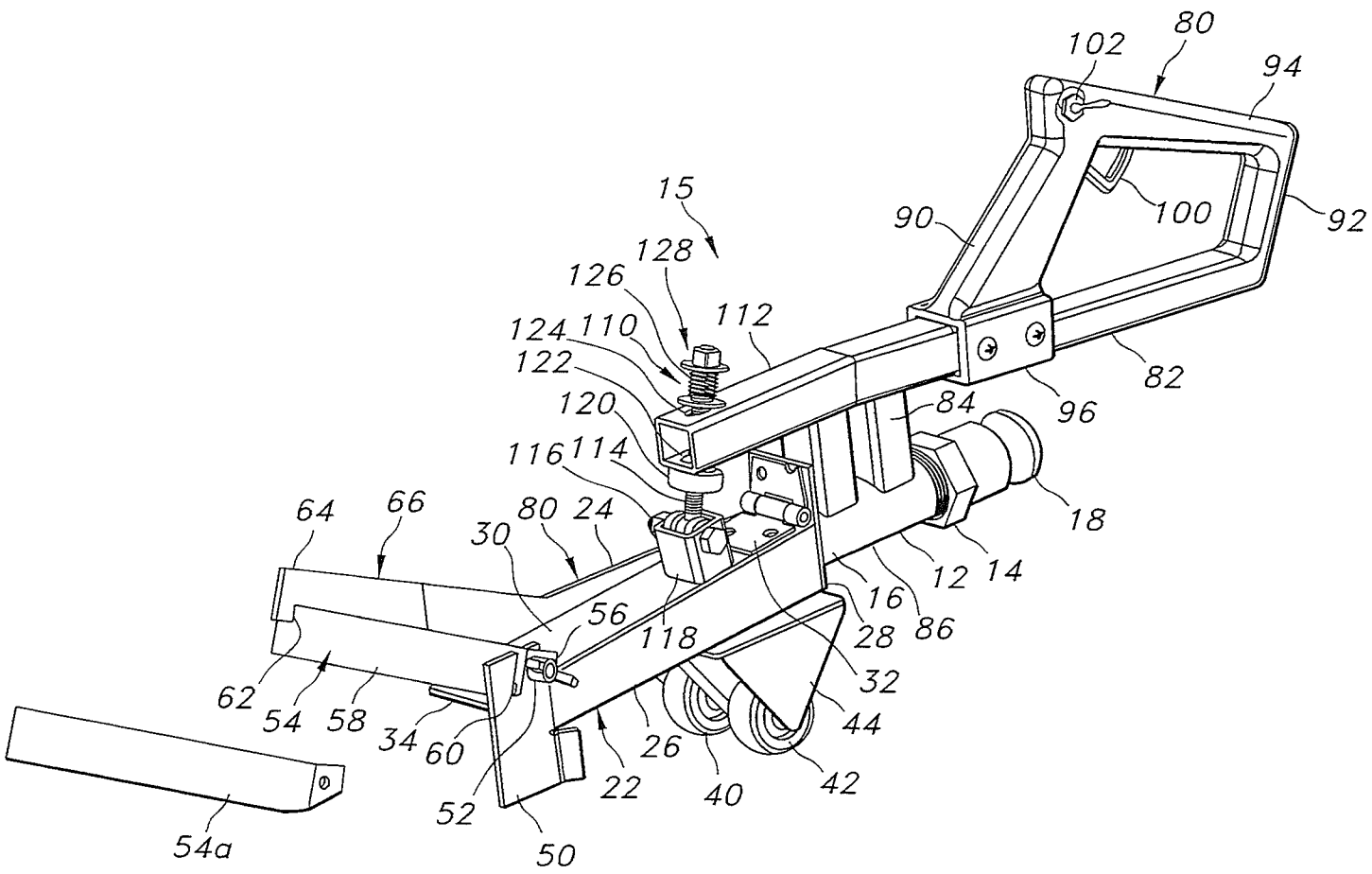
FIG. 1 is a perspective view of a first embodiment of a mortar gun assembly constructed in accordance with the present invention, illustrating apparatus for selectively extruding and applying a layer of mortar on a selected surface.
Figure 9:
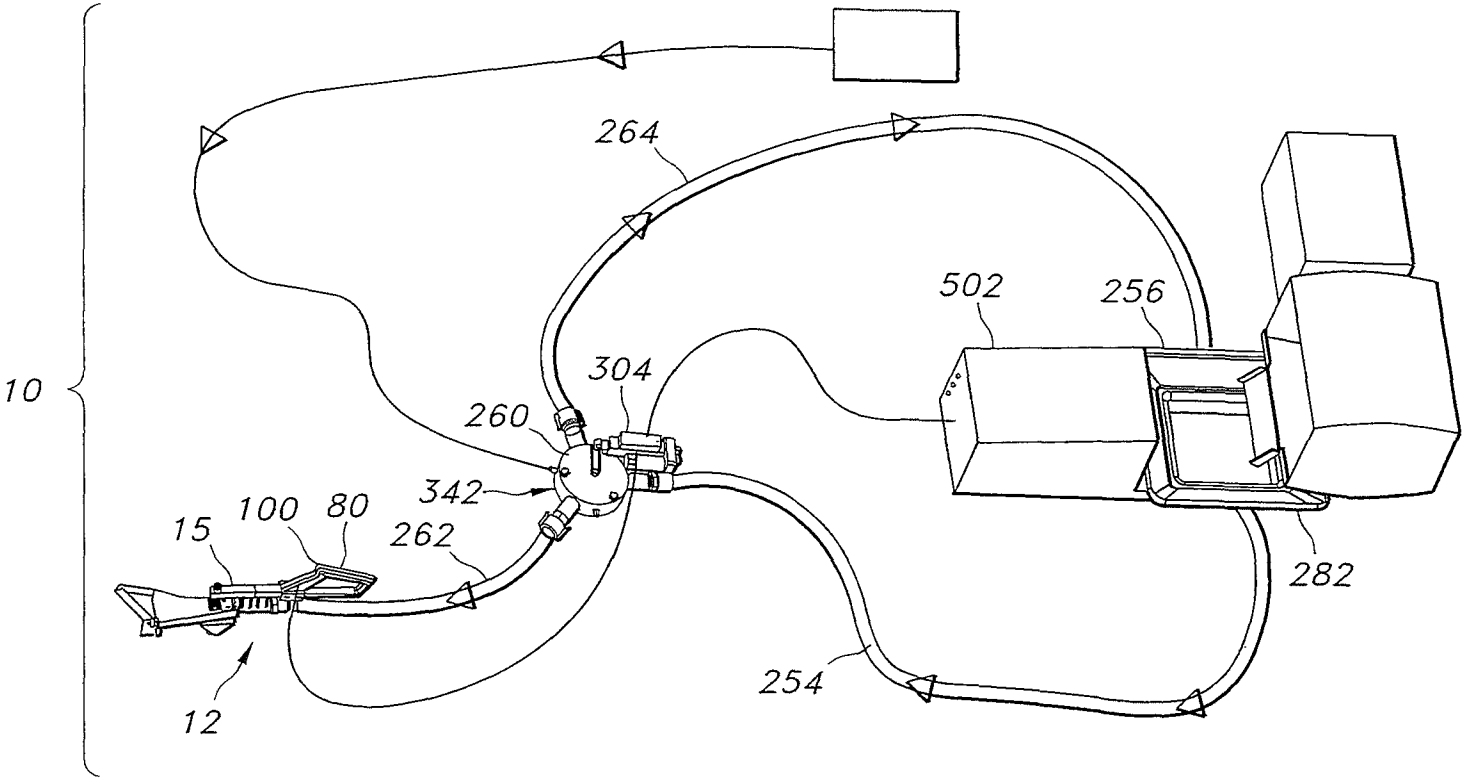
FIG. 9 is a diagrammatic top plan view of a flow circuit for the mortar extrusion and deposition system (e.g., as used with components illustrated in FIGS. 1-8), illustrating the path of mortar between a supply hopper and the mortar gun and the path of lubrication water from the water source to the valve body.

As illustrated in FIGS. 1 and 9, a mortar extrusion and deposition system 10 includes a mortar gun apparatus 15 for selectively extruding and applying a layer of mortar on a selected surface, in accordance with the present invention. Mortar gun 15 incorporates a receiver chamber 12 having a proximal inlet end 14 in fluid communication with an outlet end 16. The chamber 12 is illustrated as being a pipe that is generally cylindrical in cross-section, but it will be understood that other shapes may be used. An inlet connector 18, preferably of the well-known quick-release type, is releasably secured at inlet end 14 of the chamber 12 to receive a slurry or fluid (e.g., mortar) under pressure from a remotely located hopper, as through a suitable connector hose, to be described. The outlet end 16 of chamber 12 is connected to a distal extruder assembly 20, which is configured, in the illustrated embodiment, to distally extrude a ribbon of mortar having a selected extruded width (e.g., about 3½ inches wide), suitable for use in laying bricks, for example.

The extruder assembly 20 is generally rectangular in cross-section having a bottom plate, or wall 22, spaced upstanding side walls 24 and 26, and a rear wall 28. The extruder assembly incorporates a movable outlet gate 30 which is a top wall, or plate that is pivotally connected to the rear wall of the extruder by a hinge 32 and extends forwardly between walls 24 and 26. The gate pivots on hinge 32 so that its forward or distal end 34 is movable toward or away from the bottom wall 22 to form a variable outlet aperture through which a continuous, substantially rectangular cross-section ribbon can be extruded. The thickness of the ribbon is controllable by the rate at which the mortar is extruded, the proximal motion of the mortar gun along the selected deposition or work surface, and the position of the gate 30 with respect to the bottom wall 22, which controls the height of the extruder distal end outlet aperture.

The mortar gun 15 and the extruder 20 are supported by a pair of spaced-apart support wheels 40 and 42 mounted in a suitable bracket 44 secured to the bottom wall 22 of the extruder. A side wall guide plate 50 is secured to the forward or distal, end of the side wall 26 of the extruder and extends forwardly and downwardly to engage the side of a lower course of bricks to maintain proper alignment of the extruded material with the top surface of the brick or other surface onto which it is being applied. The short leg 52 of an L-shaped bar 54 (see also 54A) is removably secured at the top of the guide plate 50, as by a bolt and wingnut 56, with the long leg 58 of the bar extending through a slot in plate 50 and across the front of the extruder to form a rake, or screed. The free end of bar 54 engages a downwardly-facing slot 62 in the forward end 64 of a support bracket 66 forming the forward end of side wall 24 to hold the free end of the screed in place above the extruder outlet. The rake bar is easily removed by releasing the thumbscrew 56, so that different sizes (e.g., 54A) may be used to produce the desired thickness of the mortar being applied.

A suitable proximally projecting handle 80 for manipulating the mortar gun 15 may include, for example, a horizontal base rail 82 secured to the top of chamber 12 by a pair of vertical posts 84 and 86. The handle includes front and rear vertical arms 90 and 92 and a top rail 94 forming a hand loop that is secured to the horizontal base as by welding, in the case where the chamber and handle are constructed of steel. The handle base rail, arms and top rail preferably are tubular, with the free, or front, arm being flared open to form a bracket 96 that may be welded or bolted to the horizontal rail 82. Other construction methods will be apparent to those of skill in the art.

As illustrated in FIGS. 1 and 9, mortar gun assembly 15 of the present invention includes a manually operable trigger 100 which is mounted on the inner side of the handle assembly 80 for easy access by the user of the mortar gun. The trigger is connected to a linear actuator to selectively control a rotary port valve, to be described, to regulate the flow of mortar to and through the chamber 12 and through the outlet end of the extruder for deposition on a selected surface. Also located on the handle is an on/off switch 102 for activating a mortar pump, to be described, to pump mortar from a hopper to the extruder. Electrical power is supplied to the mortar gun 10 by way of a conventional electrical supply (e.g. 502, as shown in FIG. 9).

As described above, the hinged outlet gate 30 is movable with respect to the bottom wall 22 of the extruder 20 to control the outlet opening from extruder to regulate the thickness of the extruded ribbon of mortar provided by mortar gun 15. The position of the gate is manually controlled by an adjuster 110 mounted on the forward end of a tubular handle extension 112, at the forward end of rail 82, as illustrated in FIG. 1. Adjuster 110 includes a threaded bolt 114 pivotally secured at its lower end to a pin 116 extending through the opposite side walls of a support tube 118 that is mounted on the top surface of gate 30. The bolt extends upwardly through a threaded adjuster wheel, or nut, 120, through apertures 122 and 124 in the lower and upper walls, respectively, of extension 112, and through a spring 126 to a terminal washer and nut 128 that secures the adjuster in place. Rotation of the adjuster wheel 120 compresses or releases the spring and moves the gate 30 upwardly or downwardly between the walls 24 and 26 of the extruder 20 and opens or closes the opening at the end of the extruder, allowing the user to regulate the flow of mortar out of the exit end of extruder 20.

Preferably, the extruder 20 is generally rectangular in cross-section so that it deposits or produces a generally rectangular ribbon of deposited or applied mortar upon the work surface as the gun is moved proximally or rearwardly (e.g., to the right as viewed in FIG. 1) by a mason, operator or user, with the device switched "on" to provide a slurry of mortar under pressure to the inlet hose connector 18, as will be described in greater detail below. The extruder exit opening preferably will be about 3½ inches in width for application of a suitable ribbon of mortar to a surface such as a lower course of bricks, for use in laying a second course of bricks, although extruders of different widths may also be used for this or other purposes.

Figure 10A:
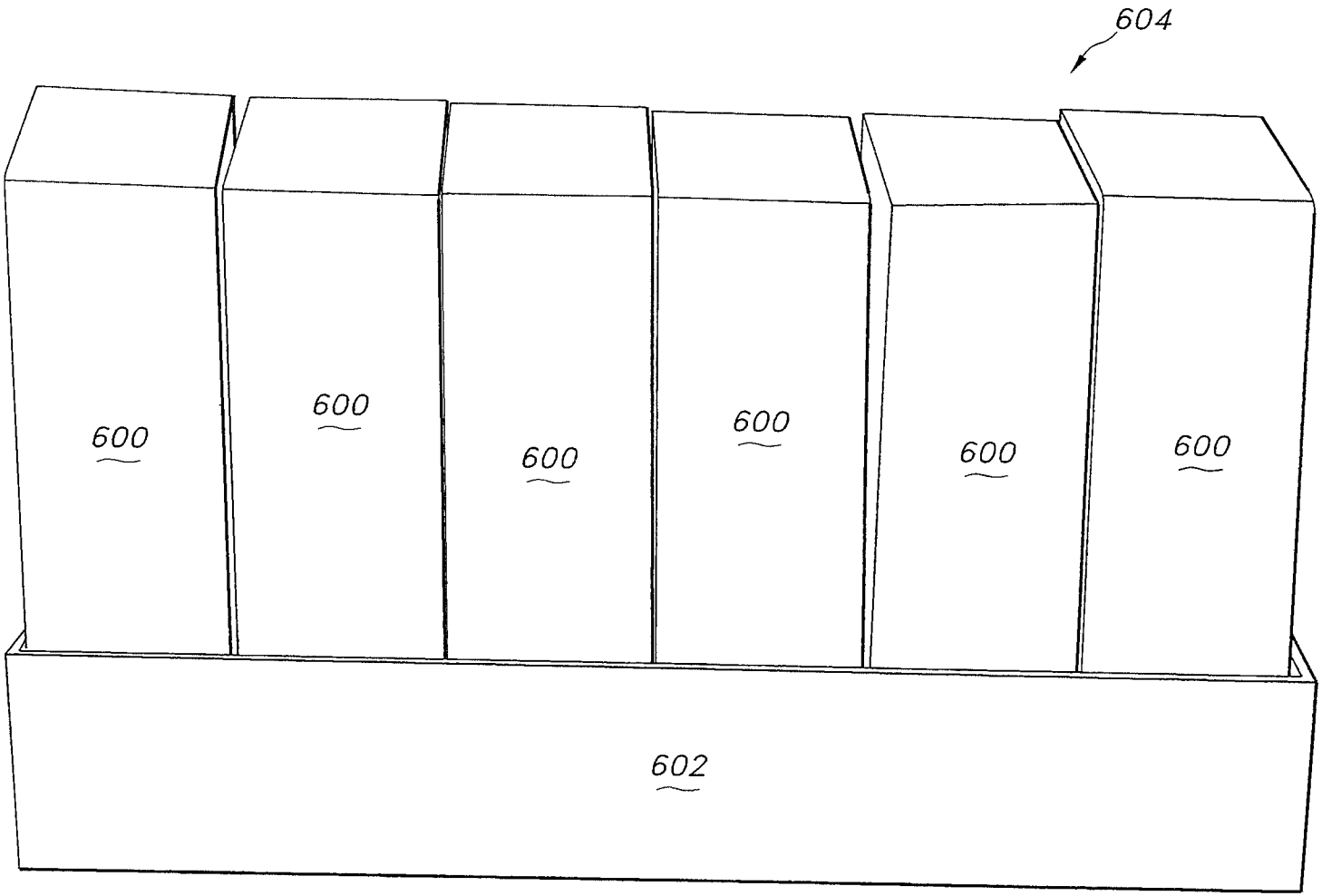
FIGS. 10A-10E are side views illustrating the use of the mortar extrusion and deposition system of the present invention when applying mortar to selected work surfaces of bricks or substrates during a brick-laying process, in accordance with the present invention.
Figure 10B:
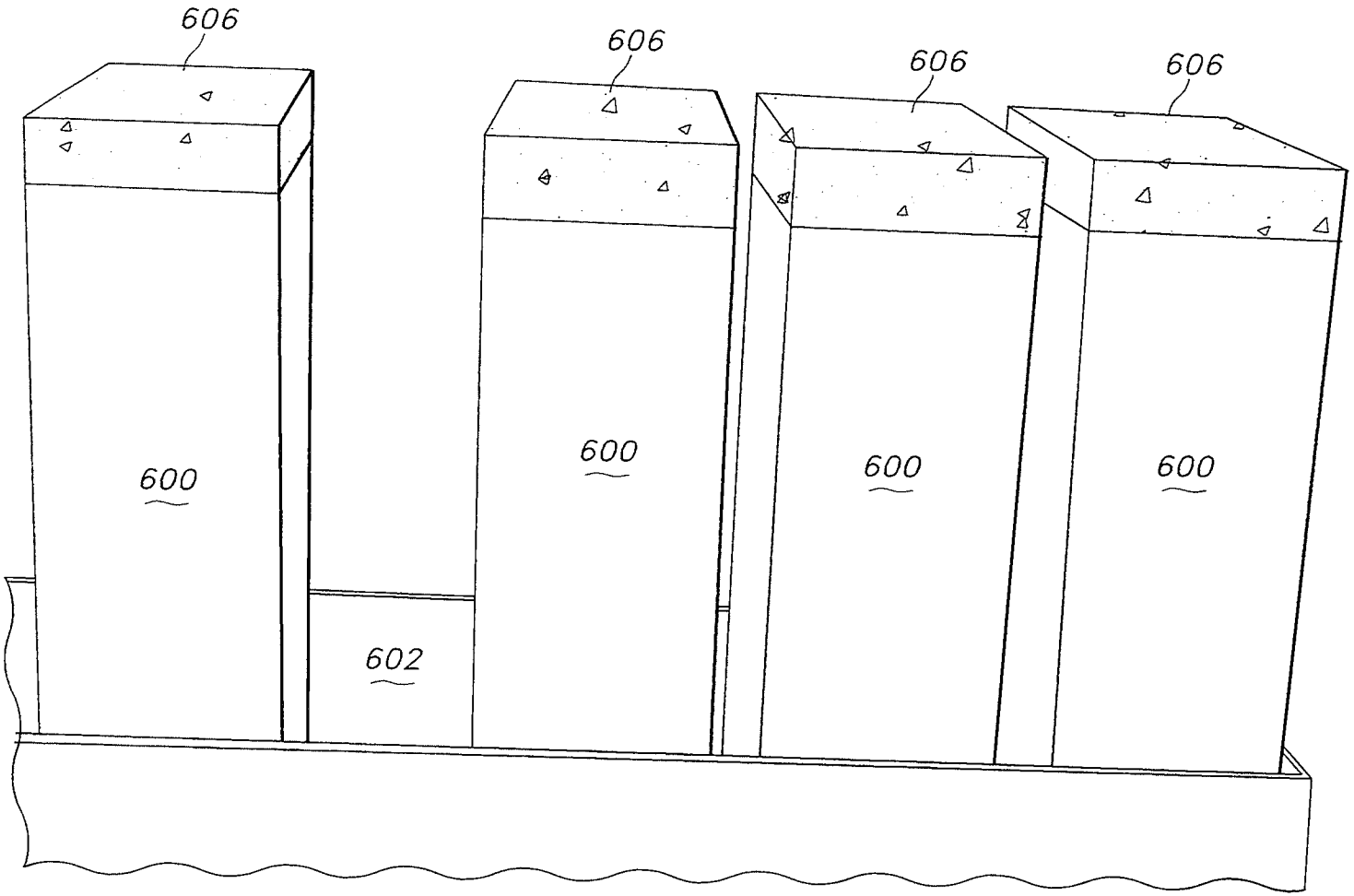
Figure 10C:
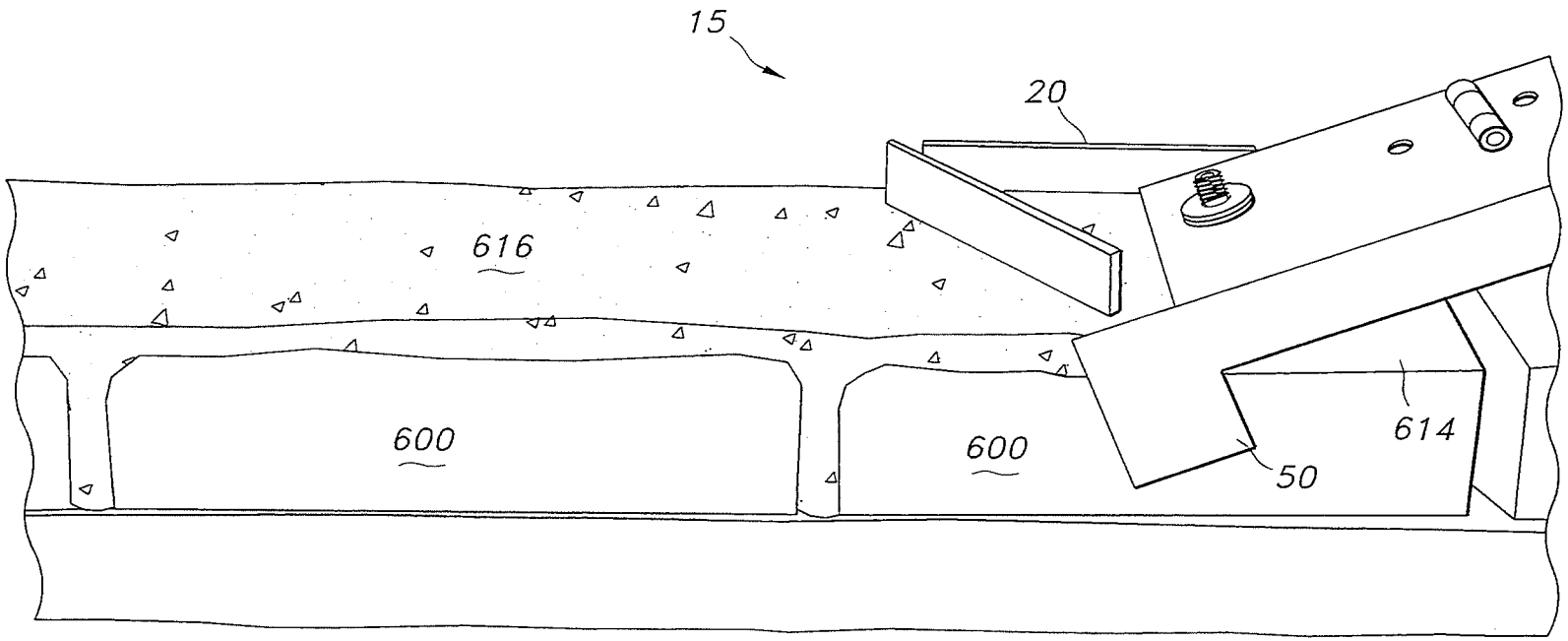
Figure 10D:
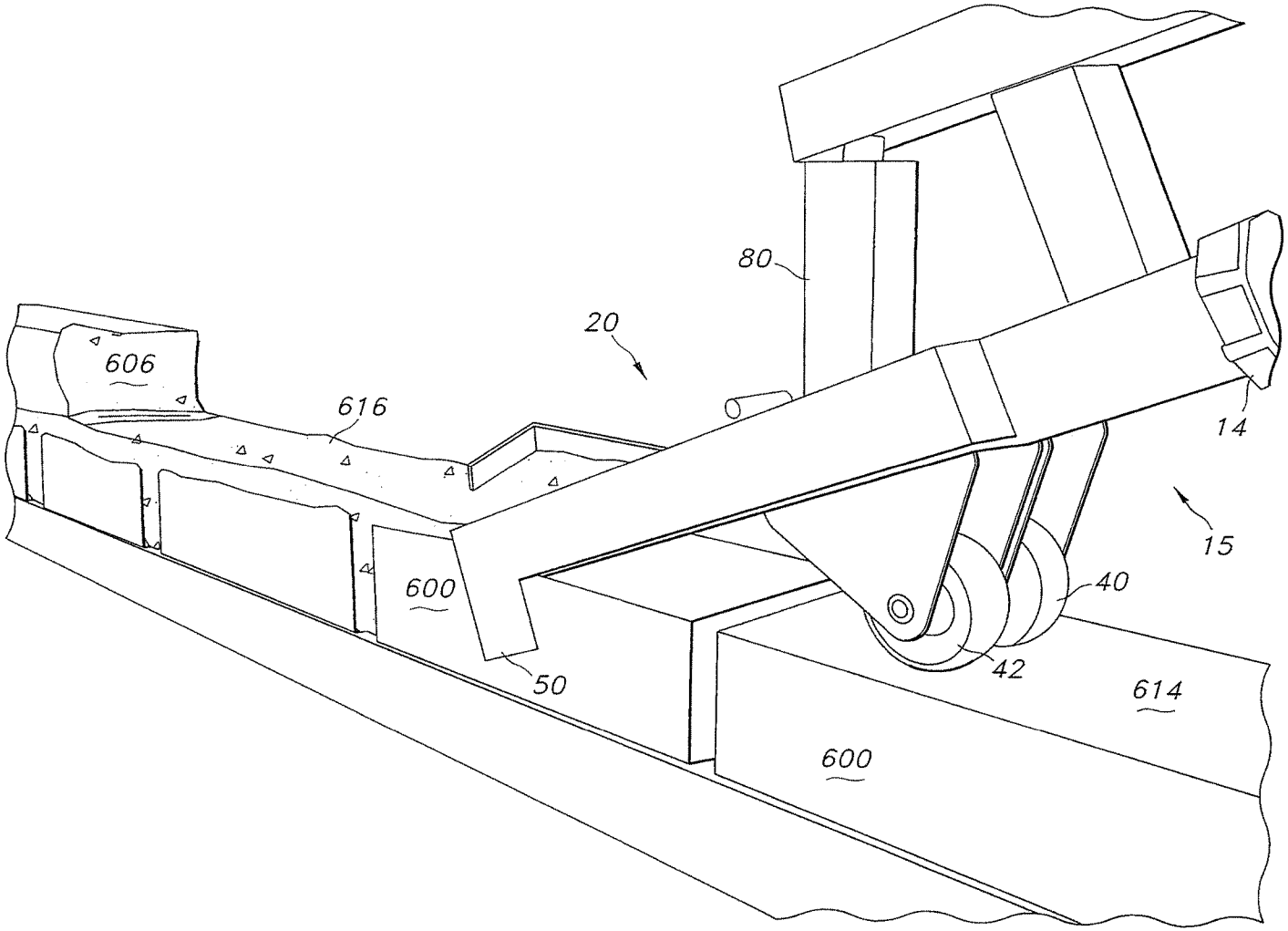
Figure 10E:
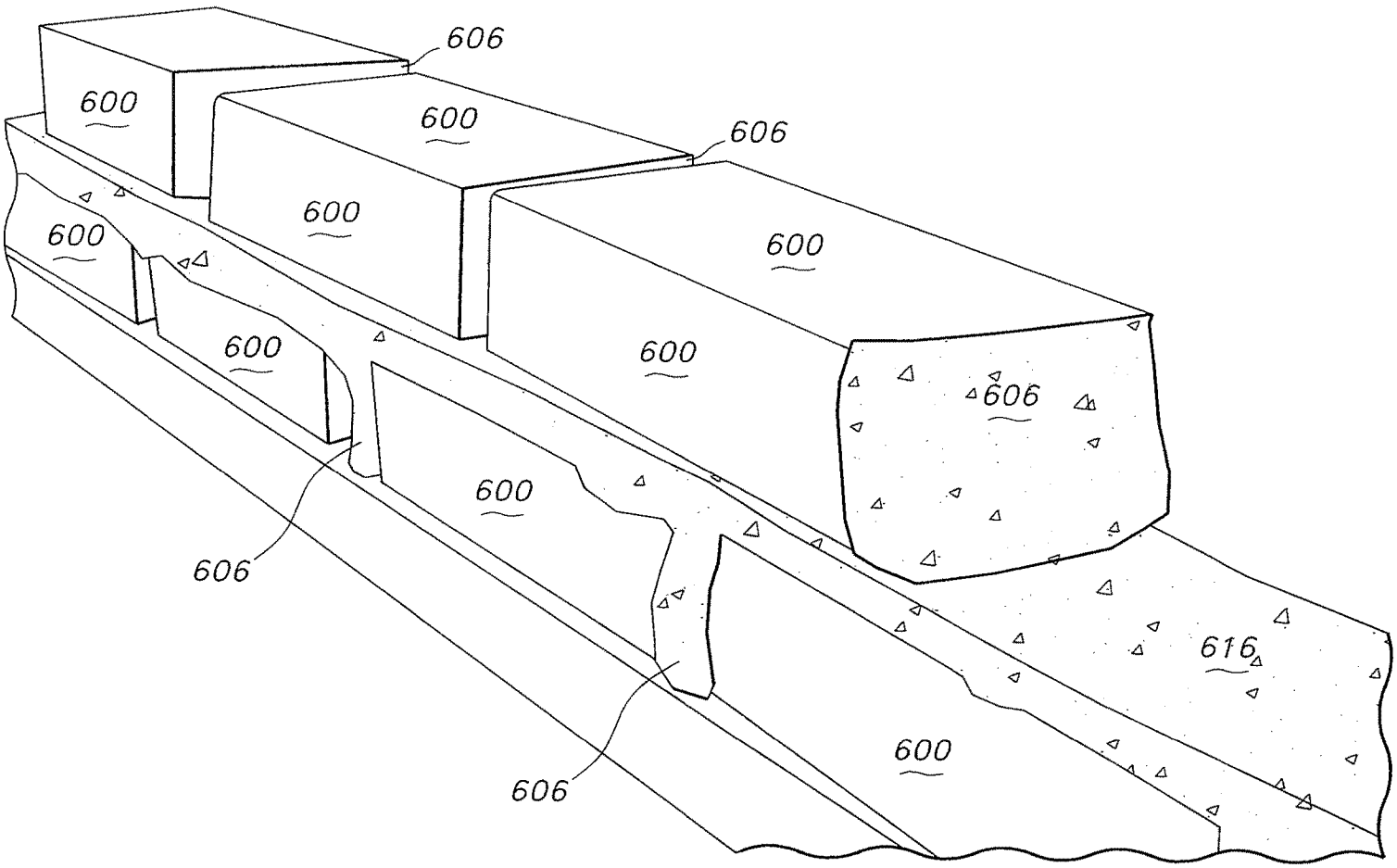

Referring now to FIGS. 10A-10E, use of mortar extrusion and deposition system 10 when laying a course of bricks is illustrated. FIG. 10A shows a selected plurality of vertically aligned bricks 600 in a box-shaped metal fixture 602 before mortar is applied. The upturned faces of these vertical bricks define a work surface 604 upon which an extruded layer of mortar 606 is to be applied. FIG. 10B shows segments of the extruded mortar layer on end of each brick with the bricks split apart ready to be laid or placed. In the next steps, the mason lays each brick with its mortar covered end aligned vertically to define a next course of bricks and FIGS. 10C, 10D and 10E show bricks horizontally applied. FIGS. 10C and 10D illustrate the orientation and alignment of mortar gun assembly 15 as it is drawn proximally along the upper surface 614 of a work surface, substrate or course of bricks, continuously depositing or applying a contiguous, unbroken layer of evenly extruded mortar 616 in preparation for laying of the next course. FIG. 10D illustrates the aligning action of guide plate 50 as it bears laterally on the face of each brick 600 during the application process of the present invention.

Figure 2:
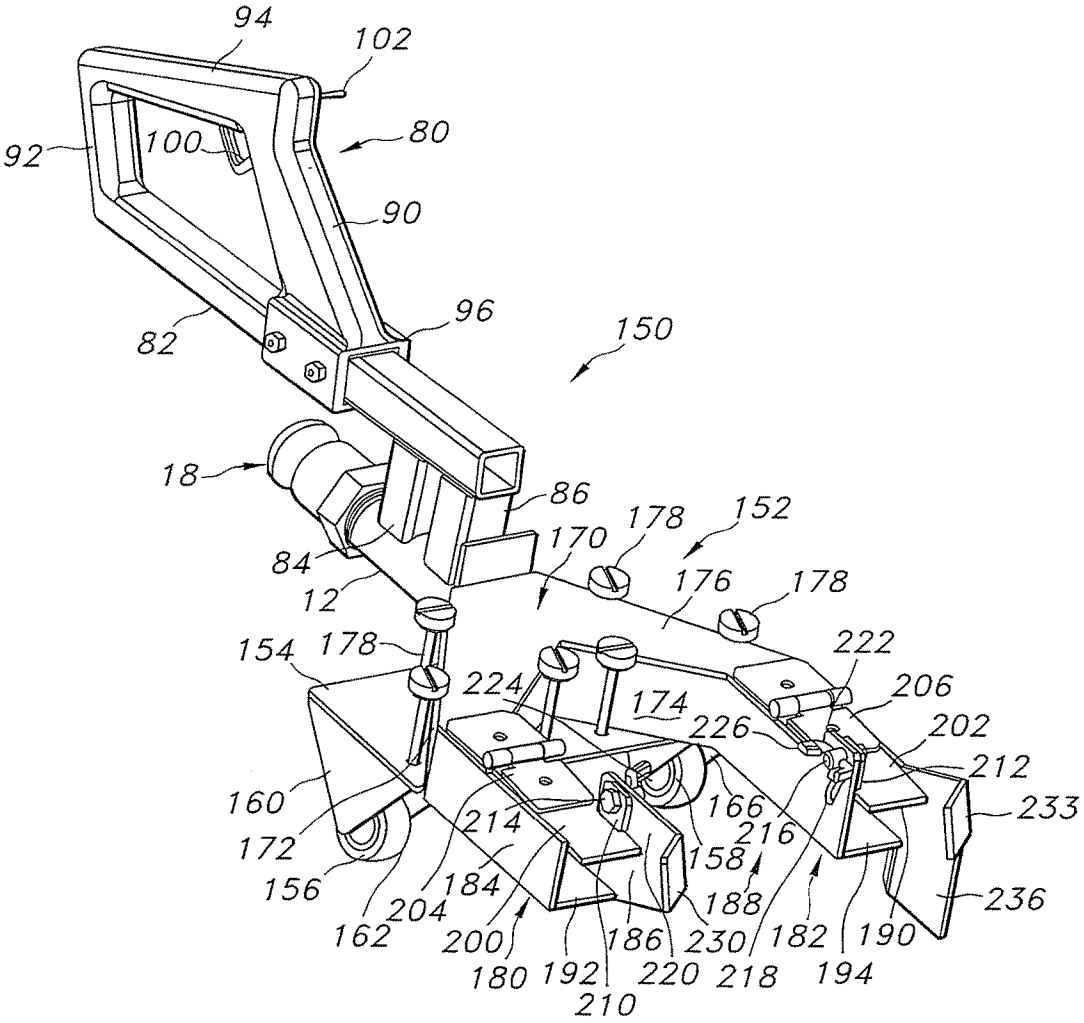
FIG. 2 is a perspective view of a second embodiment of a mortar gun assembly constructed in accordance with the present invention, illustrating apparatus for selectively extruding and applying spaced beads of mortar on a selected surface.

A second embodiment of the mortar extrusion and deposition system of the present invention is illustrated in FIG. 2, which illustrates a mortar gun 150 that is constructed to extrude a pair of spaced layers of mortar, which are referred to herein as beads, that are particularly suited for laying cement blocks, cinder blocks and the like (not shown, but in place of bricks 600). In this embodiment of FIG. 2, parts similar to the parts in the mortar gun assembly 15 of FIG. 1 are similarly numbered. In this embodiment, the chamber 12 carries the handle 80, with the front of the chamber being connected to a bead extruder assembly 152 that is supported on a carriage plate 154 having wheels 156 and 158 mounted on axles extending between downwardly-extending bracket arms 160, 162 and 164, 166, respectively. A Y-shaped extruder box 170 having a rear wall 172 connected to the chamber 12, a curved front wall 174, and a top wall 176 is secured to the carriage plate 154, as by a plurality of bolts 178 extending through corresponding tabs on wall 176 and through the plate 154.

The rear and front walls 172 and 174 of box 170 curve forwardly to form opposed walls of two spaced dispenser arms 180 and 182 on the forward end of the Y-shaped box 170, arm 180 having spaced side walls 184, 186, and arm 182 having spaced side walls 188 and 190. The arms have bottom walls 192 and 194, respectively, which may be extensions of the carriage plate 154 or which may be secured to the plate as by welding, and top walls 200 and 202, respectively. Walls 200 and 202 are disposed between the dispenser arm side walls and to the top wall 176 of the extruder box 170 by respective hinges 204 and 206 to form adjustable outlet gates. The positions of the gates within the arms are determined by adjustable stop plates 210 and 212 secured by respective bolts 214 and 216 extending through arcuate apertures, such as aperture 218, in upstanding tabs 220 and 222 on the side walls 186 and 188, and wing nuts 224 and 226. Adjustment of stops 210 and 212 controls the height of the exit openings 228 and 230 at the distal ends of dispenser arms 180 and 182, and thus controls the size of each mortar bead applied by the dispenser arms to a surface as the mortar gun is moved proximally or rearwardly by an operator.

The front ends of walls 186 and 190 are extended distally or forwardly and incorporate inwardly-extending screed portions 232 and 234, respectively. Additionally, wall 190 includes a downwardly-extending guide plate portion 236 that is positioned to contact the outer edge of a lower course of blocks to align the dispensed beads of mortar on the top surface of the blocks. The arms 180 and 182 may be spaced apart by about eight inches to accommodate conventional blocks, but other sizes may be utilized.

Figure 3:
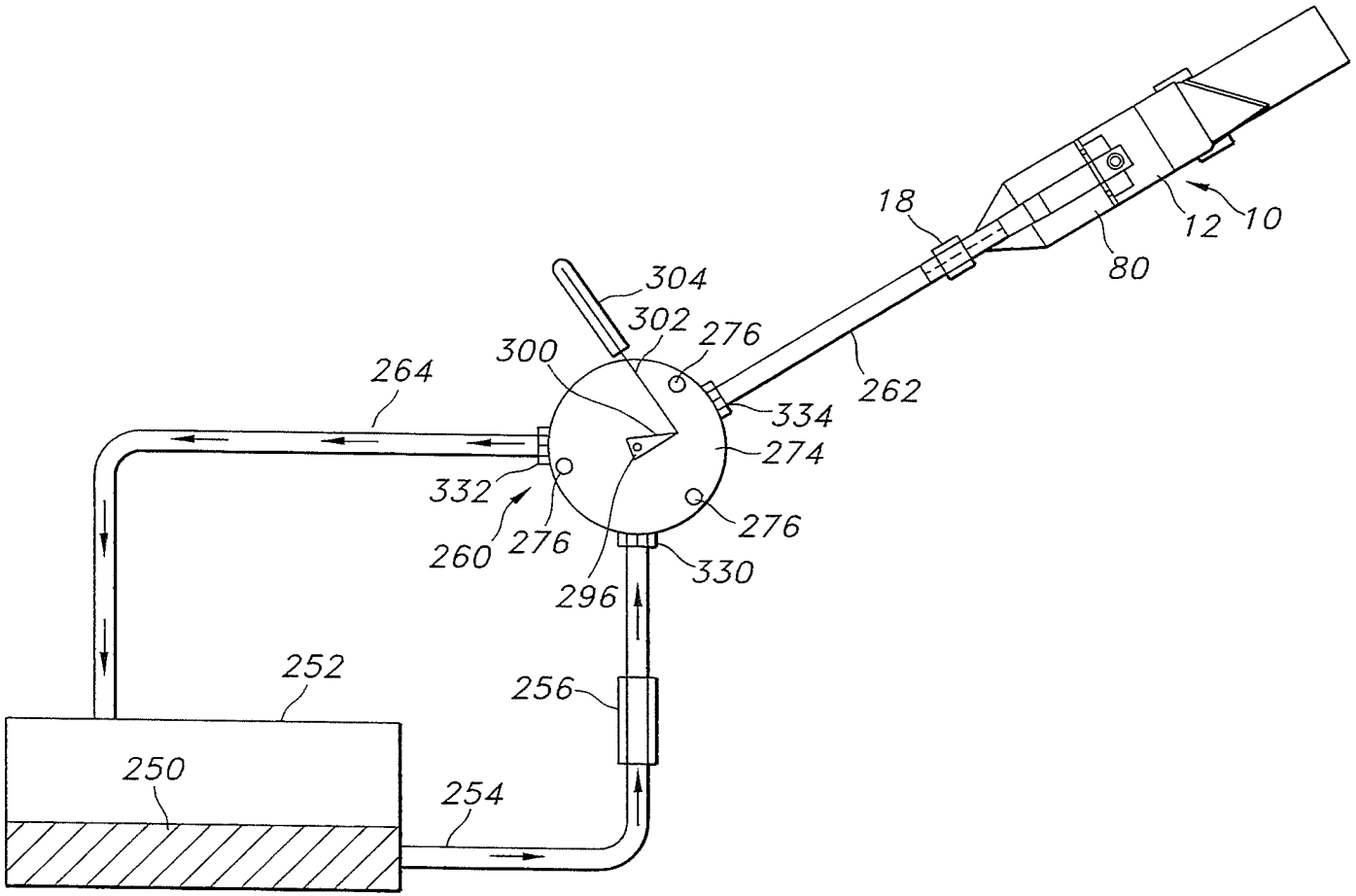
FIG. 3 is a diagrammatic top plan view of a flow circuit for the mortar gun of the present invention, illustrating the path of mortar between a supply hopper and the mortar gun.

As illustrated in FIGS. 3 and 9, the mortar gun 15 (or alternatively two-bead block mortar gun 150), is supplied with the mortar that is to be dispensed, or extruded, onto bricks, blocks or other selected work surfaces (e.g., 604 or 614 as shown in FIGS. 10A-10D), from a supply 250 of a fluid mortar mix or slurry, that is stored in a supply hopper 252 located remotely from the location where the mortar gun is to be used. The mortar is drawn from the hopper through an outflow conduit, pipe or hose 254 by a controllable electric pump 256, which may be a single-speed pump controlled by on/off switch 102 on the handle 80 of the mortar gun. If desired, a variable speed pump may be provided, controlled by a suitable speed controller that may be mounted on the handle. The mortar mix is fed to the mortar gun through a rotatable port valve 260 to a gun supply hose 262 that is connected to the inlet fitting 18 on the chamber 12, as described above.

In accordance with the present invention, the rotatable port valve has a first "active" state in which a selected slurry (e.g., mortar) is pumped from the supply hopper to gun supply hose 262 and thence to the mortar gun and is extruded out onto a course of brick or block, and a second "rest" state in which the mortar is not dispensed through the mortar gun, but is instead recirculated back to the hopper by way of return or recirculation hose 264. The outflow hose 254, valve 260, and return or recirculation hose 264 form a substantially air and fluid-tight system, and the pump operates to keep the slurry or fluid mortar 250 continuously flowing either to the gun 15 or back to the hopper 252, keeping the fluid mortar moving so does not begin to thicken, coagulate, set or dry during pauses in the extrusion of mortar from the mortar gun. Such pauses in the extrusion from the gun allow the operator, user or mason to set bricks or blocks on the extruded ribbon or beads of mortar. This valve also allows the user to pause in the application of mortar to a surface in order to avoid heat buildup in the gun assembly from friction.

Figure 4B:
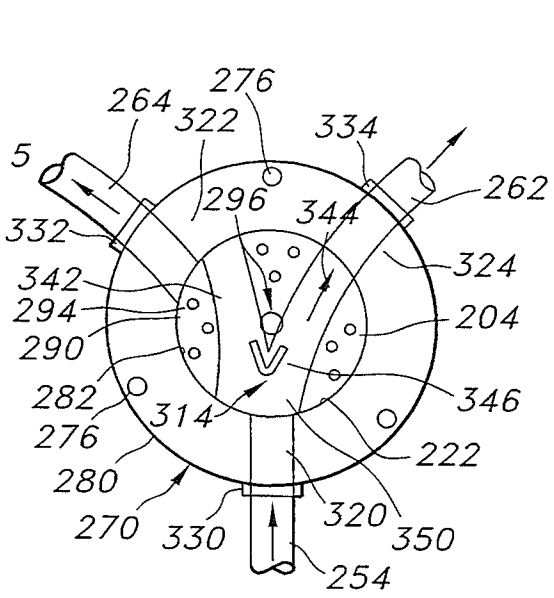
FIGS. 4A and 4B are cross-sectional views, taken along line 4-4 of FIG. 5, of a rotatable port valve for the flow circuit of FIG. 3, showing rest and active positions.
Figure 4A:
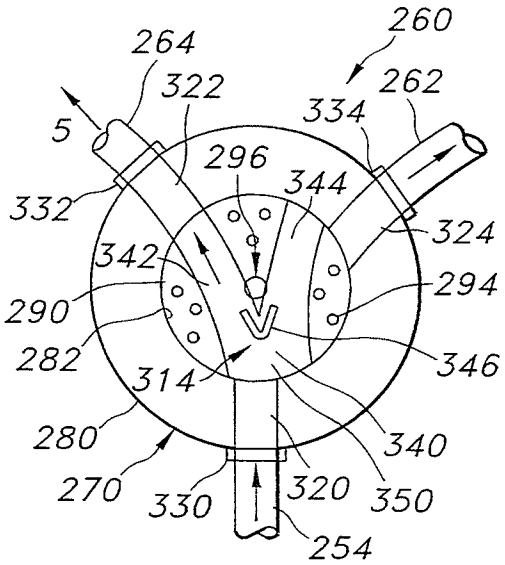
Figure 5:
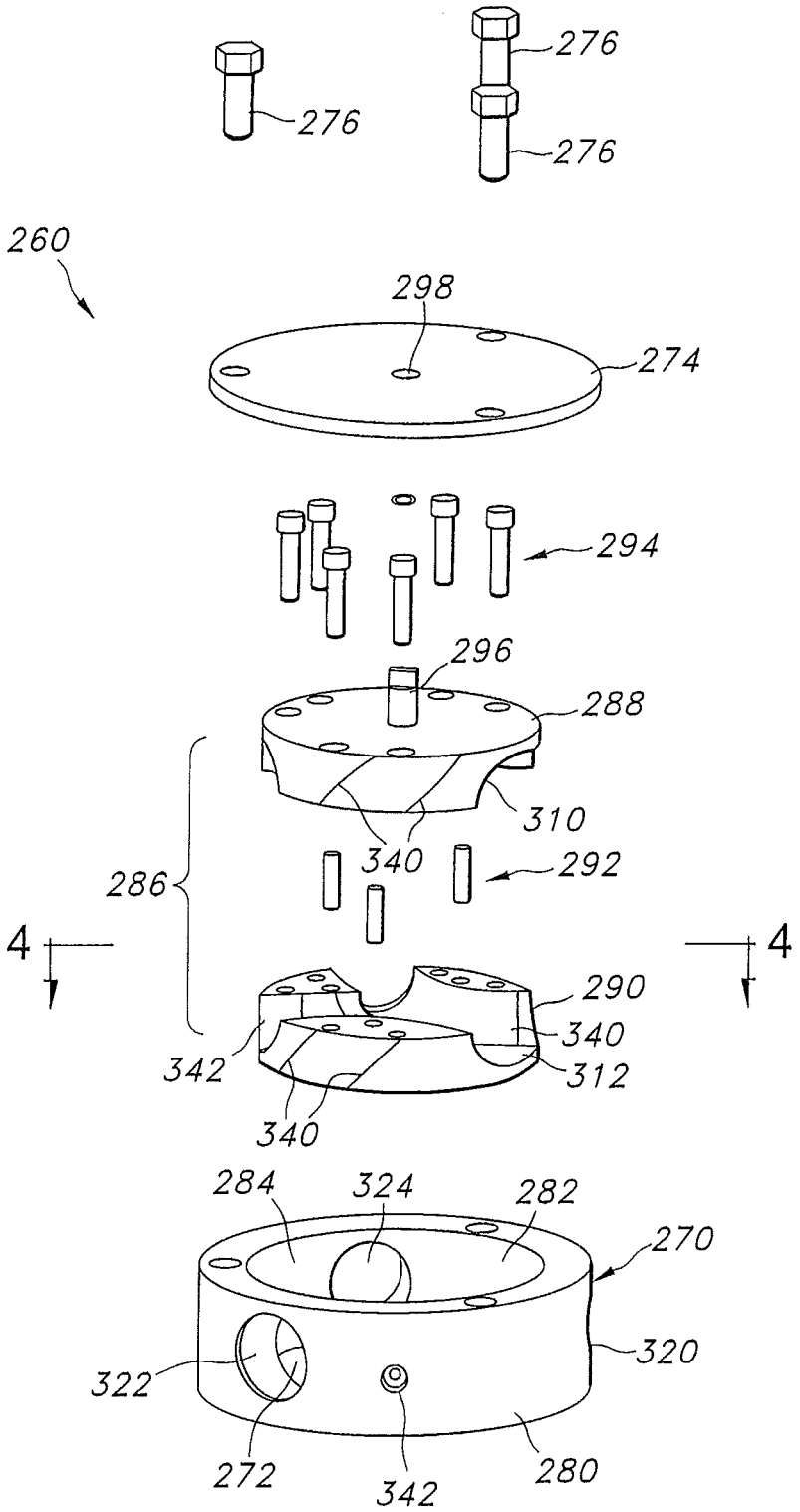
FIG. 5 is an exploded view of the valve of FIG. 4.

The valve 260, as illustrated in the embodiment of FIGS. 4A, 4B, and 5, consists of an annular main body, or valve housing 270 having a bottom wall 272 and a top cover 274 that is secured to the body by suitable fasteners such as bolts 276. The annular housing includes a cylindrical outer wall 280 and a concentric cylindrical inner wall 282 surrounding and forming a central opening 284 containing a rotatable valve body 286 formed by upper and lower portions 288 and 290, which are aligned by alignment pins 292 and secured together by suitable fasteners such as bolts 294. The valve body incorporates a central, or axial shaft 296 which extends through a central opening 298 in the top cover 274, where it is fixedly connected to an inner end of a pivot arm 300 (see FIG. 3). An outer end of arm 300 is connected to a drive shaft 302 of an electromechanical linear actuator 304, such as a solenoid operable to produce a force at a 100 lb. limit and connected through trigger 100 to a 12 VDC power source 502, to turn the center rotatable valve body 286 within valve housing 270.

The valve body 286, when assembled, is generally cylindrical, and rotatably nests in the central opening 284 of the main body 270. The upper and lower halves 288 and 290 are cut away, as at 310 and 312, respectively, so that when they are joined they define a generally Y-shaped through passageway 314 extending approximately diametrically across the valve body. Valve body 286 is rotatable to align passageway 314 with selected ones of three ports, or passageways 320, 322, and 324 spaced around and extending through the annular housing 270, as illustrated in FIGS. 4A, 4B, and 5. Port 320 serves as an inlet passageway and is connected to the inlet supply hose 254, as by a suitable connector 330 at its outer end at outer wall 280, with the inner end of the port 320 terminating at inner wall 282. Port 322 serves as a first outlet passageway extending through the main body 280 at a location generally opposite the location of port 320, but at a small angle to the left, as viewed in FIGS. 4A and 4B and has a suitable connector 332 at outer wall 280 for securing return or recirculation hose 264 to the valve 260. The inner end of port 322 terminates at the inner wall 282 of the valve body. The port 324 serves as a second outlet passageway extending through the main body 280 at a location generally opposite the location of port 320, but at a small angle to the right, as viewed in FIGS. 4A and 4B, and has a suitable connector 334 at outer wall 280 for securing supply hose 262 to the valve 260. The inner end of port 324 terminates at the inner wall 282 of the valve body.

The Y-shaped valve body passage 314 is shaped to incorporate an inlet or intake arm 340 to receive the slurry or mortar from outflow hose 254 through inlet port 320, and is divided into first and second outlet arms 342 and 344, respectively, at Y junction 346. The outlet ends of arms 342 and 344 are spaced apart by a distance less than the spacing between corresponding outlet ports 322 and 324 so that upon rotation of the valve body 286 within the main body 270, only one of the outlet arms 342 and 344 can be aligned and in fluid communication with its corresponding outlet passageway 322,324, at a time. The inlet end 350 of arm 340 is sufficiently wide to remain aligned with the inlet port 320 when either of the outlet arms is aligned with its corresponding outlet port. Accordingly, when the valve body 286 is in a rest condition, arm 342 is aligned with port 322, as illustrated in FIG. 4A, and when in an active condition the valve body 286 is rotatable to move the arm 334 into partial or full alignment with outlet port 324 under the control of trigger 100, as illustrated in FIG. 4B. Pulling or releasing the trigger 100 on handle 80 shifts the arm 300 in a clockwise (activated) or counter-clockwise (deactivated) direction to rotate the valve 286 within valve body 270 to connect the inlet port 320 to one or the other of the outlet ports 322 and 324 through the Y-shaped valve passageway.

Accordingly, rotation of valve body 286 directs fluid mortar or slurry from inlet hose 254 to one or the other of the outlet hoses 264 (in the rest condition) or 262 (in the active condition). In a preferred form of the invention, the actuator 304 is controllable by the trigger so that when in the active position the valve can be adjusted to align arm 334 with outlet 324 a selectable amount to control the rate of flow of mortar to the mortar gun. When the trigger is released, the actuator returns to its rest, or deactivated condition to recirculate mortar to the hopper. Persons of skill in the art will appreciate that the user, operator or mason can use the mortar gun's controls rotate valve body 286 to select how much of the slurry or mortar is deposited and how much (the remaining fraction of whatever is pumped) is returned or recirculated to the hopper, so that a first selected portion of the mortar is deposited and the remainder is a second portion of mortar which is recirculated.

When the top cover 274 is secured to the valve body 270, and the valve 260 is secured to the inlet and outlet hoses, it will be airtight so that circulating mortar or slurry will not dry out or start to cure while in the valve. Preferably, the rotating valve 286 has a series of 45 degree angled grooves along the body, as indicated at 340 in FIG. 5, to allow low pressure fresh lubricating water to be supplied through three spaced water conduit connected inlets 342 so that the lubricating water flows into a lubrication space defined between the valve body 286 and the inner wall 282 of the main body portion 270. This allows a flowing lubricating water jacket to form during operation to lubricate both parts in order to keep mortar slurry from sticking within the valve. Lost or excess lubricating water from the water jacket mixes with the fluid mortar and drains back to the hopper 252 through recirculator hose 264.

Figure 6:
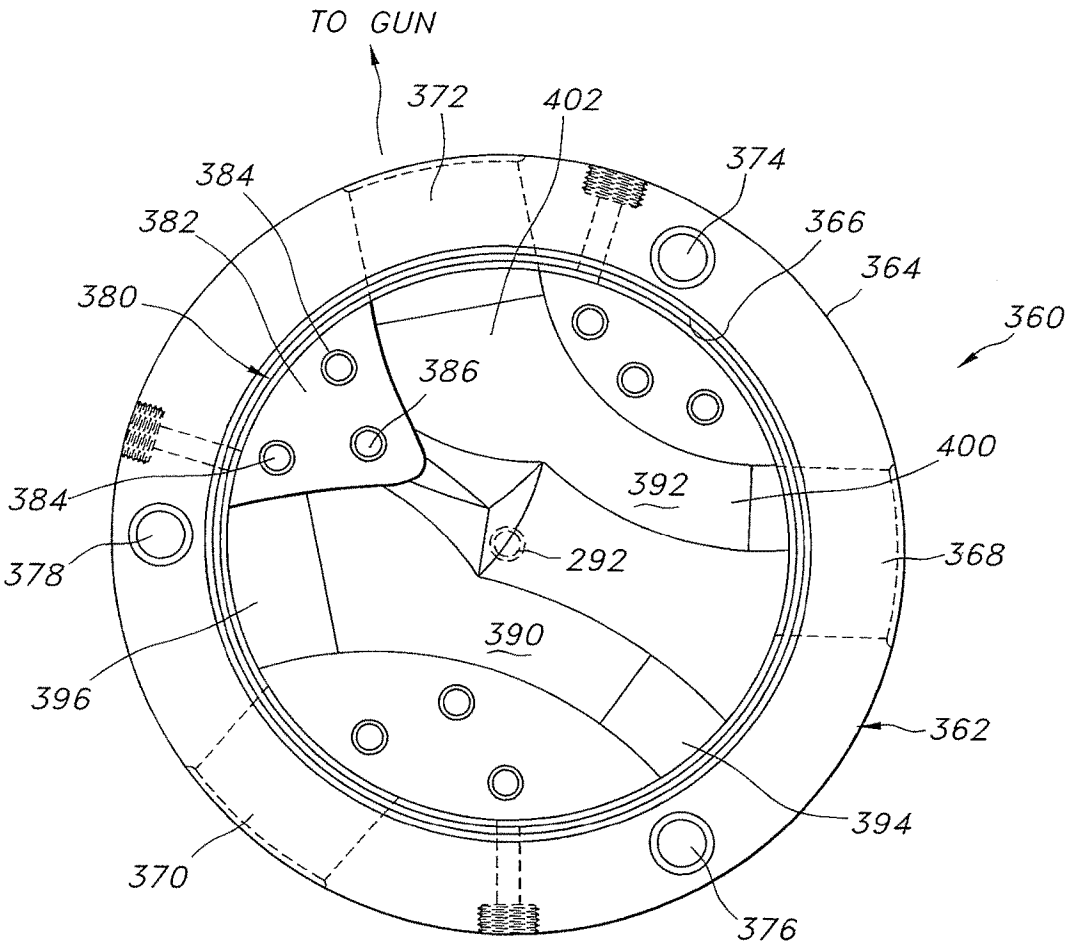
FIG. 6 is a cross-sectional view of a second embodiment of the rotatable port valve of the present invention.

FIG. 6 illustrates at 360 a modified form of the rotating valve of the invention, wherein an annular housing 362, having an outer wall 364 and an inner wall 366, incorporates three spaced ports, or passageways: an inlet port 368, and outlet ports 370 and 372. As with the device of FIG. 5, a valve cover (not shown) is securable to the valve body 362 by suitable fasteners such as bolts 374, 376 and 378. A rotatable valve body 380 is preferably fabricated in two halves, as in the embodiment of FIG. 5, with the lower half 382 being illustrated in the view of FIG. 6. Bolts 384 and alignment pins 386 are used to secure the two parts of the valve body together, as described with respect to the valve of FIG. 5. The slurry passageways formed in valve body 380 differ from those formed in the valve 286; in this embodiment, instead of a Y-shaped passageway, two separate curved passageways 390 and 392 are provided. Passageway 390 has an inlet end 394 and an outlet end 396 and is shaped so that when the valve 380 is in its rest position, as described above with the actuator 304 de-energized, inlet end 394 is aligned with inlet port 368 and outlet end 396 is aligned with outlet port 370 to provide a recirculation path for slurry. In this rest state, passageway 392 is not connected to any port. Similarly, passageway 392 has an inlet end 400 and an outlet end 402, and the passageway is shaped so that in the activated position, illustrated in FIG. 6, the inlet end 400 is aligned with inlet port 368 and the outlet end is aligned with outlet port 372 to supply mortar slurry to the mortar gun 15 (or 150). The valve can be rotated, by positioning the actuator via operation of trigger 100, to align more or less of the outlet end 402 with port 372 to regulate the rate of flow of mortar through the valve to the mortar gun.

Figure 7:
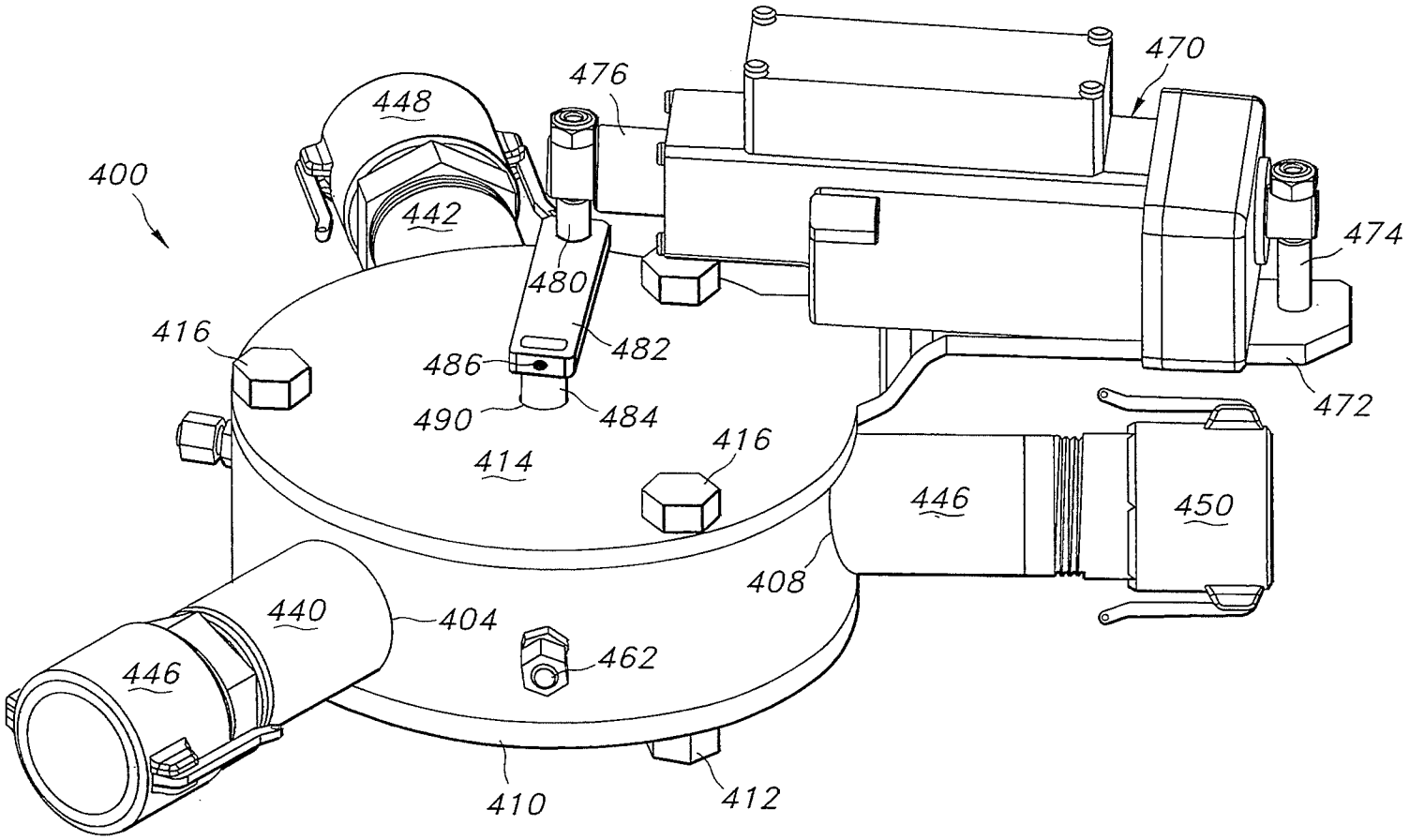
FIG. 7 is a perspective view of a third embodiment of the rotatable port valve of the present invention, illustrating a valve actuator mounted on the valve.
Figure 8:
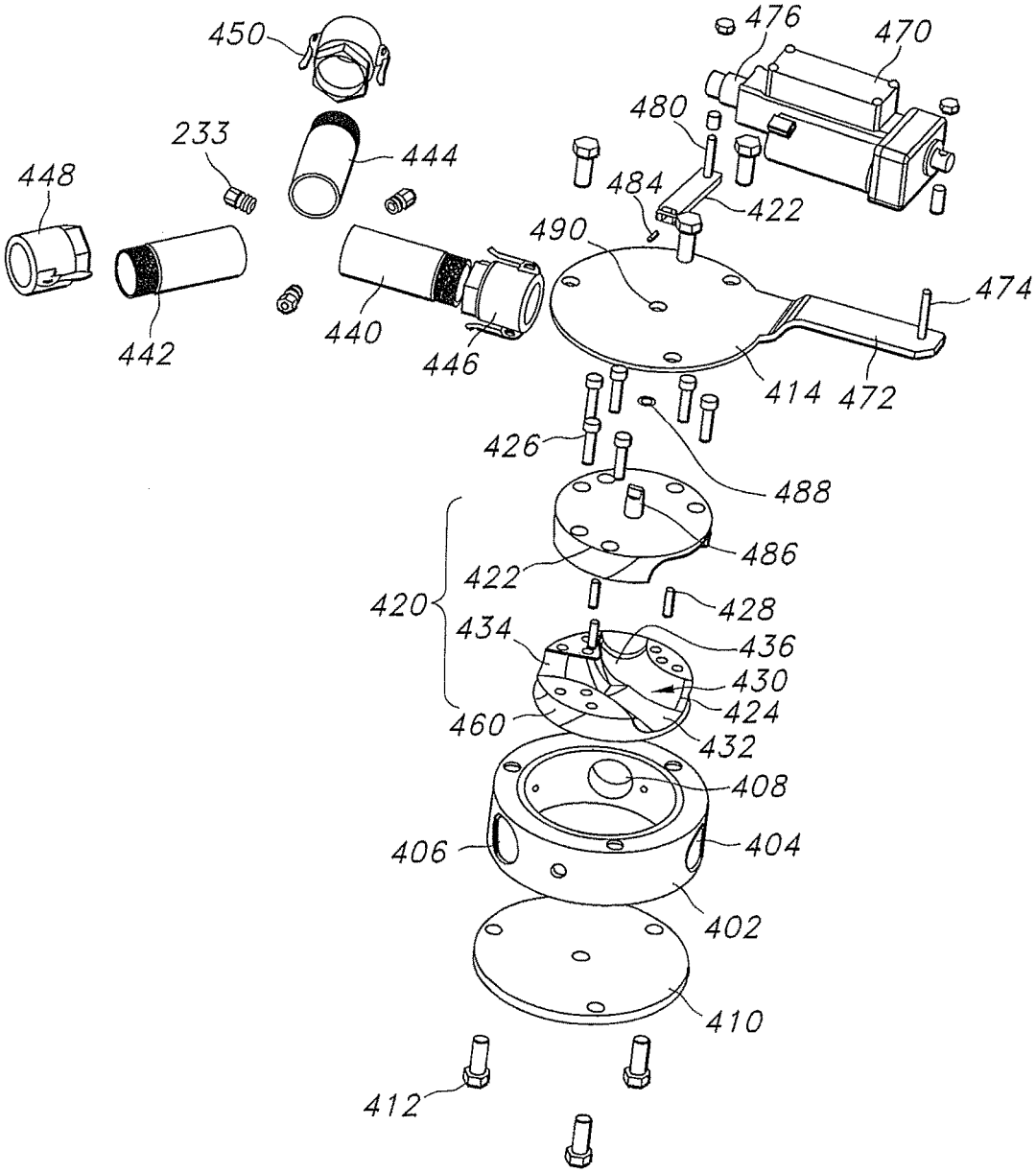
FIG. 8 is an exploded view of the valve of FIG. 7.

A third embodiment of the rotatable port valve of the present invention is illustrated in a top perspective view in FIG. 7, with its components being further illustrated in the exploded view of FIG. 8. In this embodiment, which is similar to that of FIG. 5, the valve 400 includes an annular valve housing 402 having an inlet port 404 and two spaced outlet ports 406 and 408. A bottom cover plate 410 is secured to the bottom of valve body 402 by suitable fasteners, such as bolts 412, and a top cover plate 414 is secured to the top of the valve body by suitable fasteners such as bolts 416. A rotatable valve 420 includes a top half 422 and a bottom half 424, secured together by suitable fasteners such as bolts 426 and aligned by pins 428. As described with respect to FIG. 5, in this embodiment the upper and lower halves of valve 420 are shaped to provide a Y-shaped interior passageway 430 having an inlet arm 432, a recirculator outlet arm 434, and a delivery outlet arm 436 configured to be aligned with the inlet port 404, and outlet ports 406 and 408, respectively. The valve 420 is nested within valve housing 402, with the outlet arm 434 aligned with outlet port 406 when the valve is in a rest condition and with the outlet arm 436 aligned a selectable amount with outlet port 408 when the valve is in an activated condition.

The valve 400 is connected in the flow circuit illustrated in FIGS. 3 and 9, as by way of connector pipes 440, 442 and 444 secured to ports 404, 406 and 408, respectively, with respective couplers 446, 448 and 450 securing the valve to corresponding hoses 254, 264 and 262. The outer surface of valve 420 has suitable grooves 460 to allow water supplied through water line couplers 462 to flow between the outer surface of valve 420 and the inner surface of housing 402 to lubricate the valve to facilitate relative rotation.

Rotation of the valve 420 within housing 402 is accomplished by a linear actuator 470, which may be a DufNorton Actuator TMD-1406-2, or any suitable commercially available actuator, mounted on a mounting plate 472, which in the illustrated embodiment is an extension arm formed as a part of the top cover 414, and secured by a pin 474 on the arm. The actuator 470 has a drive shaft 476 that is secured, as by a pin 480, to an outer, or free end of a lever arm 482 that is secured at its inner end as by a set screw 484, to an axial shaft 486 secured to the center of valve 420 and extending through an O-ring 488 and an aperture 490 in the top cover 414. When at rest, the valve is positioned with its outlet arm 434 aligned with its corresponding outlet port 406, as diagrammatically illustrated in FIG. 4A for the similar valve 260 that is described above, and is in its recirculation configuration.

When the actuator 470 is activated, as by operation of trigger 100, the drive shaft is retracted, as illustrated in FIG. 7, to rotate valve 420 in a clockwise direction to disconnect the outlet arm 434 from port 406 and to shift the outlet arm to connect it at least partially to port 408. When initially activated, the trigger causes the actuator to step to a position where, for example, about 25% of the arm 436 extends over port 408 to allow a 25% flow of mortar slurry from the hopper to the supply hose 262. Further actuation of the trigger 100 by the mortar gun operator causes the valve to be rotated further to allow an increased flow of mortar, until the outlet arm is fully aligned with its corresponding outlet port 408 to enable 100% flow to the supply line. Thus the operator, by manipulation of the trigger, can regulate the rate of flow to the gun 10 for controlled dispensing of mortar onto a surface.

When mortar extrusion and deposition system 10 is ready to use, with mortar in the hopper, the pump 256 is turned on and the trigger 100 is in a released position, the valve 260 (or alternatively valve 360) is in the rest position of FIG. 4A, where the recirculating outlet hose 264 is connected to inlet hose 254. In this case the pump 256 is operating to draw mortar from the hopper and direct it to valve 260, which then returns the slurry or mortar to the hopper 252, where it is again drawn out by the pump, so that the mortar is continuously circulating while it is not being dispensed. When the user has positioned the mortar gun for application of a ribbon or bead of mortar, the user activates the trigger 100, shifting the valve body 276 toward the position illustrated in FIG. 4B (and FIG. 6) and directing the flow of mortar from inlet hose 254 to supply hose 262 and thus to the extruding chamber 12. As long as the user depresses the trigger 100, the mortar will continue to flow to the gun 15 (or 150) at a user-controlled or selectable rate determined by the speed of the pump, the position of the rotary valve, and by the position of the exit gate 30, or in the case of the embodiment of FIG. 2, the position of gates 200 and 202.

Although the trigger 100 may have an on/off operation which switches the rotary valve between the rest and active positions of FIGS. 4A and 4B, to turn the flow of mortar to the gun either on or off, in the preferred form of the invention the trigger 100 may incorporate a variable resistor which operates to provide a varying voltage to the linear actuator 304 (or 470) as the trigger is pulled by the operator. This variable voltage allows the user to move the actuator drive shaft 302 (or 476) a selectable amount to control the rotation of the valve 286 (in FIG. 5, or 360 in FIG. 6, or 420 in FIG. 8) to select the degree to which the corresponding outlet arms 344 (or 402, or 436) overlap the respective outlet ports 324 (or 372, or 408) to regulate the flow of mortar through the rotary valve. As most clearly illustrated in FIGS. 6 and 8, the rotation of the valve varies the overlap of the outlet arms with the respective outlet ports, with the inlet port 386 (and 404) and inlet arm 400 (and 432) being sufficiently large to enable full inflow for any amount of overlap. Accordingly, when the trigger activates the valve, the rotary position of the valve is varied to regulate the flow to the outlet line leading to the mortar gun. When the trigger is released, the valve returns to its rest position to align outlet arm 342 (FIG. 5, or 396 in FIG. 6, or 434 in FIG. 8) with outlet port 322 (or 370, or 406) to shut off the flow to the mortar gun and cause all of the pumped, pressurized slurry or mortar to be recirculated to the hopper, as described above. When activated the mortar gun of this invention allows the user to evenly deposit or apply a selected quantity and configuration of mortar onto a course of brick or block, in a substantially continuous manner.

Although the embodiments of FIGS. 1 and 2 show mortar guns having side wall guide plates (e.g., 50) to align the travel of the gun along a course of brick or block (e.g., as shown in FIGS. 10C and 10D), enabling a user to practice the method for selectively extruding and applying a layer of mortar on the upward facing surface (e.g., 614) or a row of aligned bricks, in accordance with one aspect of the present invention, it will be understood that the guide bracket may be eliminated, or may be removable, to provide a flat-work mortar gun for use on a patio, pad, walkway or other substantially open planar surface. In such use, the flat work mortar gun is set down and aligned upon a substantially flat surface, enabling a user to practice the method for selectively extruding and applying a wide (e.g., 12 inch wide) layer of mortar on the upward facing surface, in accordance with the present invention.

In accordance with the method of the invention, a slurry or thick paste such as cement mortar is extruded thru a mortar gun (e.g., 15 or 150) which is releasably attachable to a pumping system via quick disconnect fittings. Material (mortar or slurry) leaves the mixing and mortar pump 256, in one aspect of the method of the present invention, through a 1" hose at 80-125 psi and flows through the valve 260 (or 360), with the valve in its rest position, back to the source of material in hopper 252 through the return line 264, keeping the material in a constantly moving flow. Activation of trigger switch 100 activates actuator 304 to rotate valve 260 to shut off line 264 and open line 262 so that material is sent to the gun, where it is dispensed. Releasing the trigger de-energizes the actuator and moves the valve back to the rest position. If the pump runs with the valve in the rest position for more than a selected time, for example 5 minutes, a relay switch in the handle of the mortar gun may be provided to activate the trigger switch to energize the solenoid for a selected interval (e.g., 30 seconds). This rotates the valve 260 to connect hose 262 to the pump to blow new material through it to the mortar gun to keep the pump, the supply lines and the extruder from plugging up. This feature permits a user to temporarily stop the gun's extruded material flow while setting up bricks or block, moving hoses, or performing other necessary duties.

The length of the continuous unbroken layer of deposited or applied mortar (e.g., 616) is limited solely by the mortar supply, so if an unlimited supply of mortar is made available to the inlet of the three-way power valve, there is no limit on the length of mortar that can be applied to a course of brick or block. The brick mortar gun assembly 15 illustrated in the first embodiment of FIG. 1 is configured to continuously extrude a brick-width continuous, substantially rectangular cross-section slab, or ribbon for use on a course of bricks, for example (e.g., as shown in FIGS. 10C-10E). The second embodiment, illustrated in FIG. 2, is a block mortar gun 150 that is configured to continuously extrude a double bead of mortar for use on a course of blocks (not shown).

It will be apparent that the valve structure of the mortar extrusion and deposition system of the present invention can easily be cleaned by reverse flow of water through the passageways or by disassembling the valve by removing the bolts 276 and 294. A prototype of the herein described apparatus and method has been demonstrated to apply mortar to bricks in place at a rate of 135 bricks in 15 minutes when used by a single mason or user. This is a very high rate of application, given that the brick laying world record is 198 bricks in 15 minutes with two men using the traditional methods. The mortar extrusion and deposition system structure and method of the present invention provides a machine that is light enough that it does not press down on a lower course of brick so hard that the layers of mortar between lower courses are displaced or distorted when laying a higher course of bricks. The mortar gun assembly is configured to be held by the user or mason with support wheels resting on the surface to which the mortar is to be applied, but with the heavy mortar supply hopper 252 is located remotely and connected to the gun only by a supply hose, allowing the mason to evenly apply a selected configuration of mortar (e.g., 616) onto a course of brick or block, in a continuous and smooth way.

Persons having skill in the art will appreciate that the slurry or mortar extrusion and deposition system 10 makes available a system for extruding and depositing or applying a slurry, mixture or mortar upon a selected work surface or substrate (e.g., 604 or 614) using an easy to handle mortar gun assembly (e.g., 15 or 150) having a chamber connected at an inlet end to a supply hose 262 to receive a fluid mortar material from a remote supply 252. The mortar gun assembly has an extruder (e.g., 20) at an outlet end of the chamber and the extruder configured to extrude a selected shape and apply the fluid material as a bead or ribbon of selected thickness to the substrate's selected surface. A remotely controlled mortar or concrete pump 256 is connected to the supply hose via valve (e.g., 260) and outflow hose 254 to continuously deliver pressurized fluid material from remote supply 252 to the gun's chamber, and rotating port valve (e.g., 260, 360 or 400) connected to and in fluid communication with the supply hose 262 to selectively regulate the flow of the pump-pressurized fluid material or mortar to the gun's chamber when a selected portion of the fluid material or mortar is being deposited upon the selected work surface.

The rotating port valve is also connected to recirculation hose 264 which is also connected to the remote supply 252. Preferably, the gun's proximally projecting handle (e.g., 80) is secured to the top of the gun's chamber to allow a user to position, orient and proximally pull or manipulate the mortar gun while operating or actuating the manually operable controls (e.g., 100, 102) on the handle for controlling the power to the pump and the rotatable port valve. The rotating port valve (e.g., 260, 360 or 400) automatically recirculates any un-deposited portion of the pump-pressurized mortar or fluid material back to the remote supply 252 via the recirculation hose 264. Persons of skill in the art will appreciate that the method for continuously extruding and depositing or applying an unbroken layer of a selected slurry or mortar of the present invention is an improvement because the mortar gun assembly's rotating port valve regulates the flow of the fluid material or mortar from the remote supply to the chamber more effectively, and the remote mortar or fluid material supply is supported separately from and so does not add weight to the chamber and thus does not distort the extruded bead or ribbon of mortar of rows of blocks or bricks below the work surface, during application by the user.

Having described preferred embodiments of a new and improved method and apparatus, it is believed that other modifications, variations and changes will be suggested to those skilled in the art in view of the teachings set forth herein. It is therefore to be understood that all such variations, modifications and changes are believed to fall within the scope of the present invention, as set out in the following claims.

What is claimed is:

1. A method for continuously extruding and depositing or applying an unbroken layer of a mortar upon a selected work surface or substrate, comprising:

(a) providing a mortar gun assembly which includes a chamber for receiving at an inlet end mortar from a remote supply hopper and an extruder at an outlet end, the extruder being configured to apply a continuous, unbroken layer, bead or ribbon of mortar of selected thickness upon the selected work surface or substrate; said hopper being supported separately from said chamber so as not to add weight to the chamber which the user must carry and manipulate during use and securing a handle to the top of the chamber to allow a user to position and manipulate the mortar gun without supporting the weight of the hopper;

(b) providing a manually operated on/off switch on the handle for controlling a mortar pump to provide mortar from the hopper under pressure;

(c) connecting a rotating port valve between the hopper and the mortar gun assembly's chamber; wherein said rotating port valve is controllable to provide a rest state for said rotating valve in which the mortar does not flow to the mortar gun, but is instead re-circulated by the pump back to the hopper so it is kept moving and does not begin to dry or set, and provides an active state in which mortar is pumped from the supply hopper to the mortar gun to be extruded out onto the selected work surface or substrate;

(d) switching said valve to said rest state to recirculate said mortar to said hopper and leaving said valve in said rest state until said mortar gun is brought to the selected work surface or substrate;

(e) placing said mortar gun assembly onto the selected work surface or substrate; and (f) switching said valve to said active state to continuously dispense mortar from said extruder while moving said mortar gun assembly along the selected work surface or substrate.

2. The method for continuously extruding and depositing or applying an unbroken layer of mortar of claim 1, wherein said extruder is configured to apply the mortar as a bead or ribbon of selected thickness onto the selected work surface or substrate as said mortar gun assembly is moved along said selected work surface or substrate without distorting the extruded bead or ribbon of mortar during application.

3. The method for continuously extruding and depositing or applying an unbroken layer of mortar of claim 1, further comprising:

(g) regulating the flow of said mortar to the chamber by manipulating and controlling said rotatable port valve.

4. The method for continuously extruding and depositing or applying an unbroken layer of mortar of claim 1, wherein said mortar gun assembly further comprises a hinged outlet gate mounted in said extruder to control an outlet opening from said extruder to regulate the thickness of an extruded ribbon or bead of the mortar provided from the mortar gun; and wherein said method further comprises (g) regulating the thickness of said mortar by manipulating and controlling said extruder's hinged outlet gate.

5. The method for continuously extruding and depositing or applying an unbroken layer of mortar of claim 4, wherein said mortar gun assembly further comprises a hinged outlet gate mounted in said extruder to control an outlet opening from extruder to regulate the thickness of an extruded ribbon or bead of the mortar provided from the mortar gun; and an adjuster mounted on the mortar gun for controlling the position of said outlet gate, and wherein said method further comprises:

(h) regulating the thickness of said mortar by manipulating and controlling said extruder's hinged outlet gate and said adjuster for controlling the position of said outlet gate.

6. The method for continuously extruding and depositing or applying an unbroken layer of mortar of claim 5, wherein said mortar gun assembly further comprises a screed bar at the extruder outlet end to smooth the mortar; and wherein said method further comprises:

(i) regulating the smoothness of said mortar layer by manipulating and controlling said screed bar.

7. The method for continuously extruding and depositing or applying an unbroken layer of mortar of claim 6, wherein said mortar gun assembly further comprises a side guide to direct the mortar gun assembly along a desired path on said selected work surface or substrate; and wherein said method further comprises:

(i) controlling and orienting the mortar gun assembly by initially placing said mortar gun assembly on said selected work surface or substrate with one side abutting said side guide.

8. The method for continuously extruding and depositing or applying an unbroken layer of mortar of claim 1, wherein said mortar gun assembly's rotating port valve is initially connected via a supply hose to regulate the flow of said mortar from the remote supply to the chamber;

wherein said remote mortar supply is supported separately from and so does not add weight to the chamber and does not distort the extruded bead or ribbon of mortar, during application by the user.

* * * * *